United States Patent [19]

Koboshi et al.

[11] Patent Number: 4,567,134

[45] Date of Patent: Jan. 28, 1986

[54] METHOD FOR PROCESSING OF LIGHT-SENSITIVE SILVER HALIDE COLOR PHOTOGRAPHIC MATERIAL

[75] Inventors: Shigeharu Koboshi; Masayuki Kurematsu, both of Hino, Japan

[73] Assignee: Konishiroku Photo Industry Co., Ltd., Tokyo, Japan

[21] Appl. No.: 593,634

[22] Filed: Mar. 26, 1984

[30] Foreign Application Priority Data

Apr. 4, 1983 [JP] Japan ..... 58-57903

[51] Int. Cl.[4] ..... G03C 7/40; G03C 7/16; G03C 7/00

[52] U.S. Cl. ..... 430/372; 430/393; 430/552; 430/553; 430/432; 430/384; 430/385

[58] Field of Search ..... 430/372, 552, 553, 393, 430/432, 384, 385

[56] References Cited

U.S. PATENT DOCUMENTS

| | | | |
|---|---|---|---|
| 3,335,004 | 8/1967 | Wrisley et al. | 430/372 |
| 4,004,929 | 1/1977 | Orvis | 430/552 |
| 4,083,721 | 4/1978 | Inouye et al. | 430/552 |
| 4,336,324 | 6/1982 | Koboshi et al. | 430/372 |
| 4,368,257 | 1/1983 | Usagawa et al. | 430/385 |
| 4,454,225 | 6/1984 | Sakai et al. | 430/553 |
| 4,469,780 | 9/1984 | Hirai et al. | 430/454 |

*Primary Examiner*—Mary F. Downey

*Attorney, Agent, or Firm*—Frishauf, Holtz, Goodman & Woodward

[57] ABSTRACT

A method for processing of a light-sensitive silver halide color photographic material comprising a continuous processing method comprising a stabilizing processing step involving substantially no water washing step after fixing processing, characterized in that said light-sensitive silver halide color photographic material contains at least one of cyan couplers represented by the formula (I) or (II) shown below, and the amount of stabilizing solution supplemented is 0.1 to 30 times the amount carried over from the precedent bath per unit area of said light-sensitive material to be processed:

Formula (I)

Formula (II)

wherein X represents (wherein $R_2$ is an alkyl group, an alkenyl group, a cycloalkyl group, an aryl group or a hetero ring; $R_3$ is a hydrogen atom, an alkyl group, an alkenyl group, a cycloalkyl group, an aryl group or a hetero ring; or $R_2$ and $R_3$ may be bonded together to form a 5- or 6-membered ring), $R_1$ represents a ballast group and Z represents a hydrogen atom or an eliminable group through coupling with the oxidized product of an aromatic primary amine color developing agent.

13 Claims, No Drawings

METHOD FOR PROCESSING OF LIGHT-SENSITIVE SILVER HALIDE COLOR PHOTOGRAPHIC MATERIAL

BACKGROUND OF THE INVENTION

This invention relates to a method for processing of a light-sensitive silver halide color photographic material, more particularly to a method for processing of a light-sensitive silver halide color photographic material which is capable of forming a cyan dye image excellent in storage stability during storage over a long term, even when the step of washing with water may be omitted.

Generally speaking, color photoraphic images can be formed after imagewise exposure of a light-sensitive silver halide color photographic material, by color developing the image with a color developer containing an aromatic primary amine developing agent such as p-phenylenediamine, and subsequently applying processings of bleaching, fixing, washing with water and stabilizing on the developed image. In the above processing procedures, in order to expedite the processings, bleach-fixing processing is generally practiced, which performs bleaching and fixing processings at the same time.

The color photographic images obtained according to such processing steps are stored for a long term as recording, and during the storage term, undesirable phenomena such as color fading or discoloration will frequently be caused by the influences from humidity in the air, temperature and light.

The stabilizing processing in the above processing steps is a processing required particularly for enhancement of the stability during storage over a long term of the aforesaid color photographic images. These methods for stabilizing process are disclosed in, for example, U.S. Pat. Nos. 2,647,057; 2,788,274; 2,913,338; 3,667,952; 3,676,136; 2,515,121; 2,518,686; 3,140,177; 3,291,606; and 3,093,479l; Japanese Patent Publication Nos. 8779/1962, 5735/1973 and 32369/1973; Japanese Unexamined Patent Publication No. 107736/1974; and German Pat. Nos. DT-1770074, DT-1919045 and DT-2218387.

However, according to any method of these disclosures, while a slight effect can be recognized on stabilization of the color photographic image, the effect obtained cannot be satisfactory at all. Since stabilizing processing of the prior art has been practiced with a bath constituted of a single tank which is suitable for processing within a short period of time, it has not been possible to attempt to reduce the pollution load or reduce the amount of water.

Further, stabilizing processing wherein the step of washing with water is omitted is also known as disclosed in U.S. Pat. No. 3,335,004. However, this method is a silver stabilizing processing with a thiocyanate and a large amount of sulfite is contained in the stabilizing bath. Therefore, the image dye formed is liable to be converted to a leuco form to have great influences on deterioration of the color photographic images.

Further, as the method in which the water washing step is omitted or the amount of washing water is extremely reduced, there have been proposed the multi-stage countercurrent stabilizing processing technique as disclosed in Japanese Unexamined Patent Publication No. 8543/1982 corresponding to U.S. Pat. No. 4,336,324 and a processing technique with the use of a stabilizing solution containing a bismuth complex as disclosed in Japanese Unexamined Patent Publication No. 134636/1983 corresponding to application Ser. No. 460,988 file date Jan. 25, 1983.

In either of these cases, while it is a technique to reduce the amount of stabilizing solution supplemented in continuous processing, the fixing agent and the soluble silver complex salt in the stabilizing solution will be increased by the fixing solution carried over with the photographic material to be processed if the amount of the stabilizing solution supplemented is reduced extremely, whereby stability of the cyan dye to light (light fading characteristic) was found to be lowered. This phenomenon may be prevented by increasing the number of stabilizing tanks, by employment of a multi-stage countercurrent system, by use of increased amount of stabilizing solution supplemented and by provision of a large volume of washing water between the fixing solution and the stabilizing solution. However, these measures are not advantageous from the standpoint of compaction of the processing instrument and protection of water resources. Accordingly, it would be desirable to have a stabilizing processing technique which is more compact and small in the amount of stabilizing solution supplemented.

SUMMARY OF THE INVENTION

It is a first object of this invention to provide a method for stabilizing processing of a light-sensitive silver halide color photographic material capable of forming a stable color photographic image during a long term storage even when the step of water washing processing may be omitted.

It is a second object of this invention to provide a method for processing of a light-sensitive silver halide color photographic material which can reduce the amount of stabilizing solution supplemented or reduce the number of the stabilizing baths, thereby enabling reduction in pollution load and cost as well as compacting of the processing instrument.

The method for processing of a light-sensitive silver halide color photographic material according to this invention is a continuous processing method comprising a stabilizing processing step involving substantially no water washing step after the fixing processing, wherein said light-sensitive silver halide color photographic material contains at least one of cyan couplers represented by the formula (I) or (II) shown below, and the amount of the stabilizing solution supplemented is 0.1 to 30 times the amount carried over from a precedent bath per unit area of said light-sensitive material to be processed:

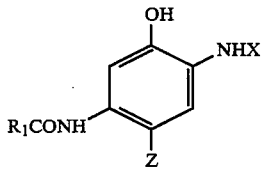

Formula (I)

-continued

Formula (II)

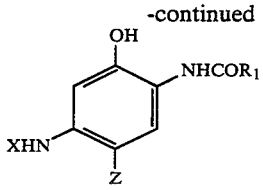

wherein X represents

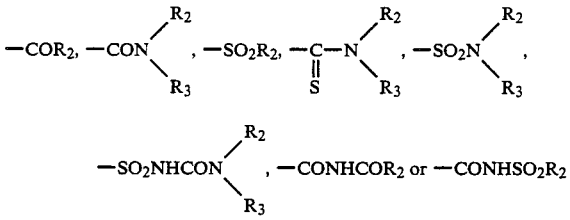

($R_2$ is an alkyl group, an alkenyl group, a cycloalkyl group, an aryl group or a hetero ring; $R_3$ is a hydrogen atom, an alkyl group, an alkenyl group, a cycloalkyl group, an aryl group or a hetero ring; or $R_2$ and $R_3$ may be bonded together to form a 5- or 6-membered ring), $R_1$ represents a ballast group and Z represents a hydrogen atom or an eliminable group through coupling with the oxidized product of an aromatic primary amine color developing agent.

DESCRIPTION OF THE PREFERRED EMBODIMENTS

In the stabilizing processing wherein water washing processing is substantially omitted, whereby the processing is made continuous from fixing processing or bleach-fixing processing directly to stabilizing processing, a large amount of the components in the fixing solution and the bleach-fixing solution which is the precedent bath must inevitably be carried over into the stabilizing solution with the light-sensitive material to be processed. When stabilizing processing is performed without substantially carrying out water washing processing in the continuous processing by means of an automatic developing machine, the light fading of cyan dye was found to be worsened and it was not possible to reduce the number of tanks for stabilizing solution or the amount of the stabilizing solution to be supplemented to a great extent.

The present inventors, as a result of extensive studies, have found that worsening of the light fading of a cyan dye was due to a soluble silver complex salt or a decomposed product of a soluble silver complex salt remaining in the light-sensitive material, and also found that the effect by such a soluble silver complex salt or its decomposed product is more strengthened by the presence of an organic ferric salt such as iron (III) ethylenediaminetetraacetate complex salt in the stabilizing solution.

The present inventors, as the result of further progress of the studies, have found that very excellent characteristics of storage stability of a cyan dye to light can be exhibited when stabilizing processing is applied by use of the light-sensitive silver halide color photographic material containing the cyan coupler of this invention.

Also, according to this invention, in the light-sensitive silver halide color photographic material containing the cyan coupler of this invention, a surprising discovery has been made that the dye obtained by continuous processing with the stabilizing processing by using the supplemental amount of this invention is improved in light fading stability of the cyan dye, as compared with the dye obtained by the water washing processing or the stabilizing processing with greater supplemental amount of the prior art. The fact that stability of dye is higher as the residual reagent is less is entirely unexpected from the knowledge commonly accepted in the prior art.

In this invention, "to perform stabilizing processing without substantially passing through the step of water washing processing" means that it does not exclude processing such as rinsing processing, auxiliary washing with water and known washing water accelerating bath of a very short period of time by means of a single bath or a plural bath counter-current system to an extent such that the concentration of the fixing solution or bleach-fixing solution in the forefront tank in said stabilizing processing is not diluted to 1/30 or less.

In this invention, fixing processing is carried out in a processing bath containing a solubilizing complexing agent which solubilizes a silver halide as a silver halide complex salt, and not only fixing solutions, but also bleach-fixing solutions, one bath developing-fixing solutions and one bath developing-bleach-fixing solutions are included.

To describe in more detail, in carrying out generally continuous photographic processing, the fixing bath and the bleach-fixing bath contain soluble silver ions, in addition to fixing agent such as thiosulfates or sulfites. And, in this invention, presence of such soluble silver ions or decomposed products of silver salts will act advantageously.

This invention has been accomplished on the basis of such facts as described above, ant it is more desirable to constitute the stabilizing processing step of a multiple number of tanks in order to further develop the effect of this invention. The most desirable amount of the stabilizing solution supplemented is of course determined depending on the number of tanks for the stabilizing solution.

Although the cyan coupler of this invention exhibits more preferably storage stability of dye, when the soluble silver salt or its decomposed product in the fixing solution or bleach-fixing solution is mixed in the stabilizing solution in a certain amount, presence of such a component in too much an amount is restricted by another problem of generation of yellow stain. Accordingly, it is not possible to lower extremely the supplemented amount without limitation, and even within the range of supplemental amount of this invention, it is preferred to increase the number of processing tanks when the amount of the stabilizing solution supplemented is within the range from 0.1 to 20 times, desirably from 0.5 to 10 times.

To describe in more detail, the effect can be exhibited with the use of a supplemental amount of stabilizing solution in an amount within the range from 0.1 to 30 times the volume carried over from the precedent bath per unit area of the light-sensitive material. Desirably, however, processing is conducted with 3 to 30 times in the case of one stabilizing processing tank, with 0.3 to 20 times in the case of two stabilizing processing tanks, 0.1 to 10 times in the case of three stabilizing processing tanks and 0.1 to 5 times in the case of four stabilizing processing tanks. However, five or more tanks are not preferable in view of stability of the dye, and processing is required to be done with at most 7 tanks. At a level of 0.1 times of the supplemental stabilizing solution of this invention, concentration through evaporation of the solution will cause a problem to result in generation of precipitates. On the other hand, in excess of 30 times, the light fading of the dye by the coupler of this invention is increased, and it is not of course desirable from the standpoint of economy and prevention of environmental contamination.

The stabilizing solution in this invention has a pH which is not particularly limited, but preferably a pH of 0.1 to 10, more preferably of 3 to 9 and particularly preferably of 6 to 9. The stabilizing solution of this invention may desirably contain a pH buffering agent added therein in order to have a buffering action. Said buffering action is known to be played generally by a mixed solution (salt) of a weak acid and a strong base relative thereto or by a mixed solution (salt) of a weak base and a strong acid relative thereto. Typical examples of such acid salts may include acetate, borate, metaborate, phosphate, mono-carboxylate, di-carboxylate, poly-carboxylate, amino acid salt, aminocarboxylate, primary phosphate, secondary phosphate, tertiary phosphate and the like. Further, various kinds of chelating agents may also similarly be added. Examples of such agents are aminopolycarboxylates, aminopolyphosphonate, phosphonocarboxylate, alkylidenediphosphonate, polyphosphate, pyrolate, metaphosphate, gluconate, etc.

In addition, as conventional additives generally known in the art, there are, for example, fluorescent whiteners, surfactants, antifungal agents, preservatives, organic sulfur compounds, onium salts, film hardeners and others.

As the antifungal agents, there may be employed, for example, isothiazoline type, benzyimidazole type, benzisothiazoline type, thiabendazole type, phenol type, organic halo-substituted compounds, mercapto type compounds, benzoic acid and derivatives thereof, and at a neutral pH, isothiazoline type or benzisothiazoline type antifungal agents may preferably be used, while under acidic conditions, thiabendazole type, phenol type, benzoic acid, etc. may preferably be used. The amount of these additives into the stabilizing bath added may be varied as desired necessary for maintaining the pH of the stabilizing bath and within the range, provided that there is no bad influence on stability during storage of the color photographic image and generation of precipitates, and any compound may be used in any desired combination. However, according to the processing method of this invention, which is capable of efficient silver recovery and non-pollution processing, the concentration is desired to be as dilute as possible, if sufficient buffering ability is provided, from the stand point of pollution load and cost.

The processing temperature during stabilizing processing may be 15° to 60° C., preferably 20° to 45° C. The processing time may preferably be as short as possible from the standpoint of rapid processing, but generally 20 seconds to 10 minutes, most preferably 1 to 5 minutes, the processing time being preferably shorter in the earlier stage tanks and longer in the later stage tanks.

Before or after the stabilizing processing of this invention, no water washing processing is required at all, but rinsing with a small amount of water within a very short period of time or surface cleaning with a sponge may be conducted freely if desired.

The processing method of this invention may be employed also for processing of color paper, reversal color paper, color posi film, color nega film, color reversal film, color X-ray film, etc.

The cyan couplers represented by the formula (I) and (II) used in this invention are to be described in detail below.

In the formulae (I) and (II), X is a group represented by

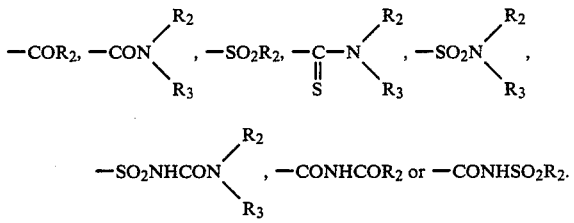

Here, $R_2$ represents an alkyl group (preferably an alkyl group having 1 to 20 carbon atoms, such as methyl, ethyl, butyl, dodecyl), an alkenyl group (preferably an alkenyl group having 2 to 20 carbon atoms, such as oleyl), a cycloalkyl group (preferably a 5- to 7-membered ring, such as cyclohexyl), an aryl group (e.g. phenyl, tolyl, naphthyl), a heterocyclic group (preferably a 5- to 6-membered hetero ring containing 1 to 4 nitrogen atom, oxygen atom or sulfur atom, such as furyl group, thienyl group, benzothiazolyl group). $R_3$ represents a hydrogen atom or a group represented by $R_2$. $R_2$ and $R_3$ may be bonded together to form a 5- to 6-membered hetero ring containing a nitrogen atom. Any desired substituent may be introduced into $R_2$ and $R_3$. For example, there may be included alkyl groups having 1 to 10 carbon atoms (e.g. ethyl, i-propyl, i-butyl, t-butyl, t-octyl), aryl groups (e.g. phenyl, naphthyl), halogen atoms (e.g. fluorine, chlorine, bromine atoms), cyano, nitro, sulfonamide groups (e.g. methanesulfonamide, butanesulfonamide, p-toluenesulfonamide), sulfamoyl groups (e.g. methylsulfamoyl, phenylsulfamoyl), sulfonyl groups (e.g. methanesulfonyl, p-toluenesulfonyl), fluorosulfonyl, carbamoyl groups (e.g. dimethylcarbamoyl, phenylcarbamoyl), oxycarbonyl groups (e.g. ethoxycarbonyl, phenoxycarbonyl), acyl groups (e.g. acetyl, benzoyl), heterocyclilc groups (e.g. pyridiyl group, pyrazolyl group), alkoxy groups, aryloxy groups, acyloxy groups, and so on.

In the formulae (I) and (II), $R_1$ represents a ballast group necessary for imparting a diffusion resistance to the cyan coupler represented by the formulae (I) and (II) and the cyan dye formed from said cyan coupler. Preferably, it is an alkyl group having 4 to 30 carbon atoms, an aryl group or a heterocyclic group. For example, there may be included straight or branched alkyl groups (e.g. t-butyl, n-octyl, t-octyl, n-dodecyl), alkenyl groups, cycloalkyl groups and 5- to 6-membered heterocyclic groups.

In the formulae (I) and (II), Z is a hydrogen atom or an eliminable group during coupling reaction with the oxidized product of the color developing agent. For example, there may be included halogen atoms (e.g. chlorine, bromine and fluorine atoms); aryloxy groups, carbamoyloxy groups, carbamoylmethoxy groups, acyloxy group, sulfonamide groups and succinimide groups, of which oxygen atom or nitrogen atoms is bonded directly to the coupling position; etc. Further, specific examples may include those disclosed in U.S.

Pat. No. 3,741,563, Japanese Unexamined Patent Publication No. 37425/1972, Japanese Patent Publication No. 36894/1973, Japanese Unexamined Patent Publication Nos. 10135/1975, 117422/1975, 130441/1975, 108841/1976, 120334/1975, 18315/1977, 105226/1978, 14736/1979, 48237/1979. 32071/1980, 65957/1980, 1938/1981, 12643/1981 and 27147/1981.

In this invention, the cyan couplers represented by the following formulae (III), (IV) and (V) are further preferred.

Formula (III)

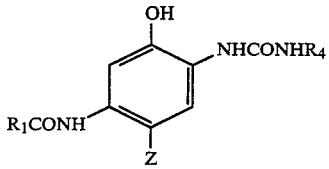

Formula (IV)

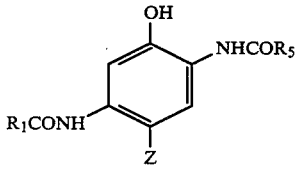

Formula (V)

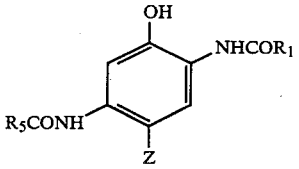

In the formula (III), $R_4$ is a substituted or unsubstituted aryl group (particularly preferably a phenyl group). As the substituents when said aryl group has a substituent, there may be included $-SO_2R_2$, halogen atoms (e.g. fluorine, bromine, chlorine atoms), $-CF_3$, $-NO_2$, $-CN$, $-COR_6$, $COOR_6$, $-SO_2OR_6$,

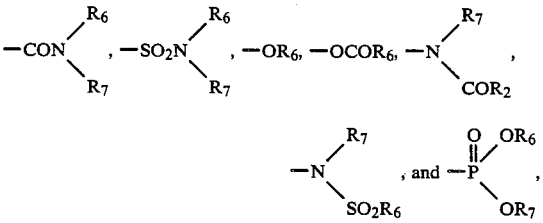

from which at least one substituent may be selected.

Here, $R_6$ represents an alkyl group (preferably an alkyl group having 1 to 20 carbon atoms, such as methyl, ethyl, t-butyl, dodecyl), an alkenyl group (preferably an alkenyl group having 2 to 20 carbon atoms, such as an allyl group, heptadecenyl group), a cycloalkyl group (preferably a 5- to 7-membered ring, such as cyclohexyl group), an aryl group (phenyl group, tolyl group, naphthyl group) and $R_7$ is a hydrogen atom or a group represented by the aforesaid $R_6$.

Suitable compounds of the phenol type cyan couplers represented by the formula (III) are compounds wherein $R_4$ is a substituted or unsubstituted phenyl group, and the substituent on the phenyl group is cyano, nitro, $-SO_2R_6$ ($R_6$ is an alkyl group), a halogen atom or trifluoromethyl.

In the formulae (IV) and (V), $R_5$ may preferably be an alkyl group (preferably an alkyl group having 1 to 20 carbon atoms, such as methyl, ethyl, t-butyl, dodecyl), an alkenyl group (preferably an alkenyl group having 2 to 20 carbon atoms such as an allyl group, heptadecenyl group), a cycloalkyl group (preferably a 5- or 7-membered ring, such as cyclohexyl), an aryl group (phenyl group, tolyl group, naphthyl group), a heterocyclic ring (preferably a 5- to 6-membered hetero ring containing 1 to 4 nitrogen atom, oxygen atom or sulfur atom, such as furyl group, thienyl group, benzothiazolyl group).

Into $R_6$, $R_7$ in the formula (III) or $R_5$ in the formulae (IV) and (V), any desired substituent may be further introduced, such as the substituents which can be introduced into $R_2$ or $R_3$ in the formulae (I) and (II). And, as the substituent, halogen atoms (e.g. chlorine and fluorine atoms) are particularly preferred.

In the formulae (III), (IV) and (V), Z and R1 have the same meanings as in the Formulae (I) and (II), respectively. Peferable examples represented by $R_1$ are groups represented by the following formula (VI):

Formula (VI)

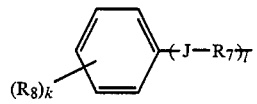

In the above formula, J represents an oxygen atom, a sulfur atom or a sulfonyl group, k represents an integer of 0 to 4, l represents 0 or 1, and when k is 2 or more, the two or more $R_8$'s may be either identical or different, $R_7$ represents an alkylene group substituted with a straight or branched alkyl having 1 to 20 carbon atoms or an aryl group, $R_8$ represents a monovalent groups such as a hydrogen atom, a halogen atom (preferably chlorine, bromine), an alkyl group [preferably a straight or branched alkyl group having 1 to 20 carbon atoms (e.g. methyl, t-butyl, t-pentyl, t-octyl, dodecyl, pentadecyl, benzyl, phenetyl], an aryl group (e.g. phenyl), a heterocyclic group (preferably a nitrogen containing heterocyclic group), an alkoxy group [preferably a straight or branched alkoxy group having 1 to 20 carbon atoms (e.g. methoxy, ethoxy, t-butyloxy, octyloxy, decyloxy, dodecyloxy)], an aryl oxy (e.g. phenoxy), hydroxy, an acyloxy group {preferably an alkylcarbonyloxy group, an arylcarbonyloxy group (e.g. acetoxy, benzoyloxy}, carboxy, an alkyloxycarbonyl group (preferably a straight or branched alkyloxycarbonyl group having 1 to 20 carbon atoms), an aryloxycarbonyl group (preferably phenoxycarbonyl), an alkylthio group (preferably having 1 to 20 carbon atoms), an acyl group (preferably a straight or branched alkyl carbonyl group having 1 to 20 carbon atoms), an acylamino group (preferably a straight or branched alkylcarboamide, having 1 to 20 carbon atoms, benzenecarboamide), a sulfonamide group (preferably a straight or branched alkylsulfonamide group having 1 to 20 carbon atoms, a benzenesulfoamide group), a carbamoyl group (preferably a straight or branched alkylaminocarbonyl group having 1 to 20 carbon atoms, a phenylaminocarbonyl group), a sulfamoyl group (preferably a straight or branched alkylaminosulfonyl group having 1 to 20 carbon atoms, a phenylaminosulfonyl group), and so on.

Specific examples of the cyan couplers to be used in this invention are enumerated below:

EXEMPLARY COMPOUNDS (1)
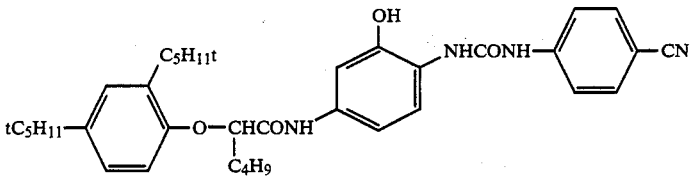
(2)
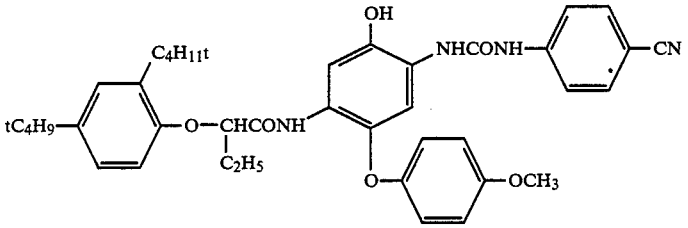
(3)
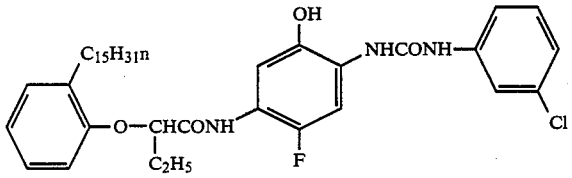
(4)
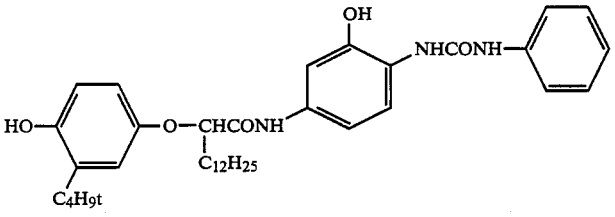
(5)
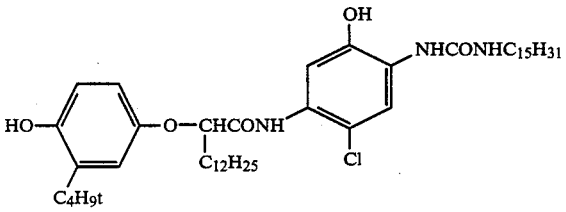
(6)
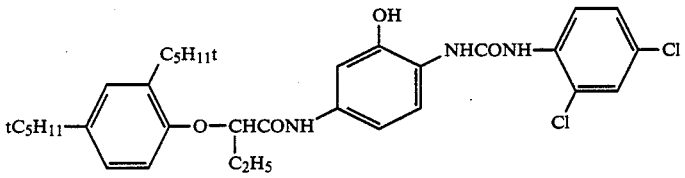
(7)
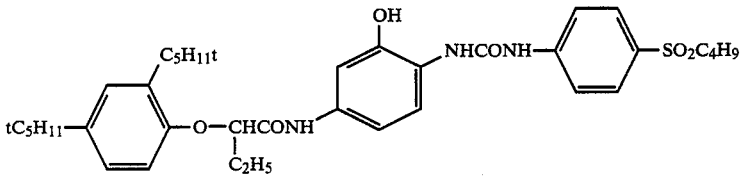
(8)
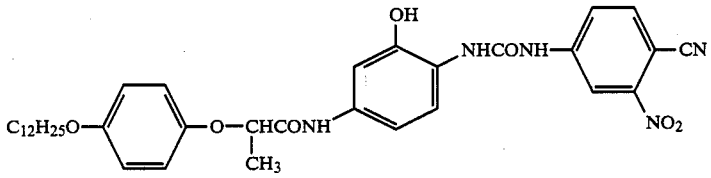

-continued
(9)
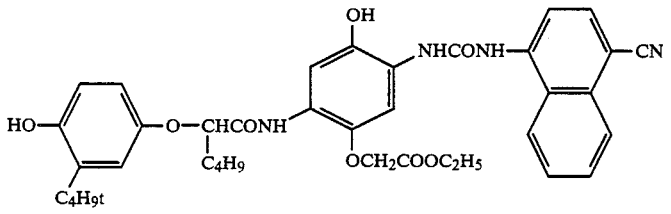
(10)
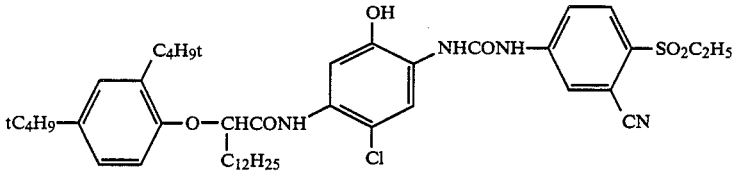
(11)
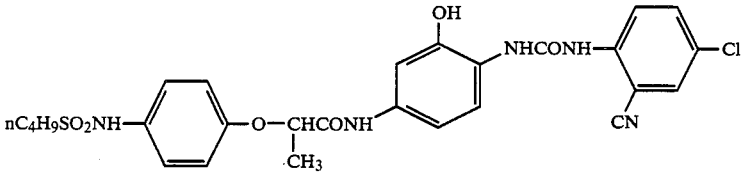
(12)
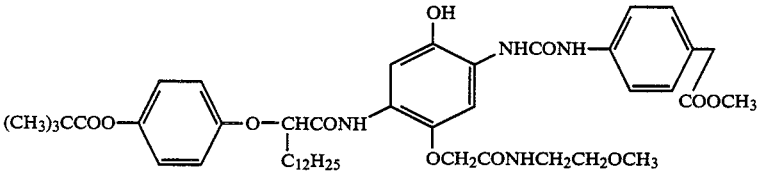
(13)
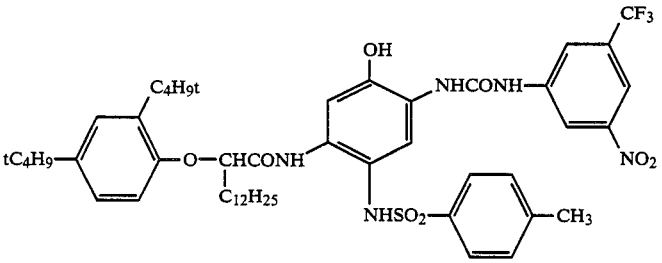
(14)
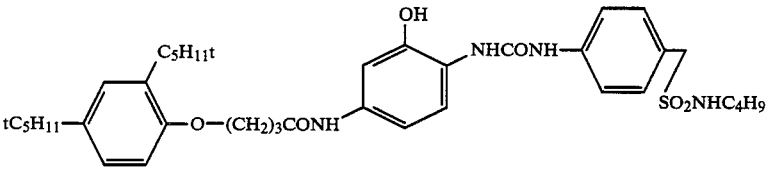
(15)
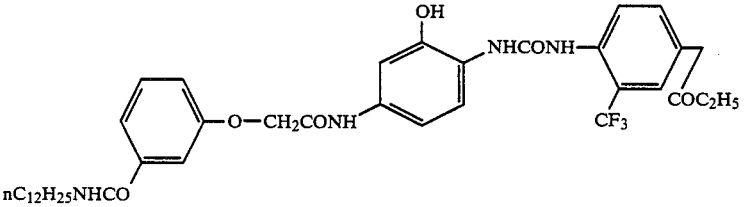

-continued
(16)
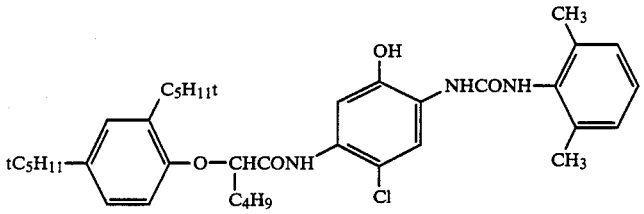
(17)
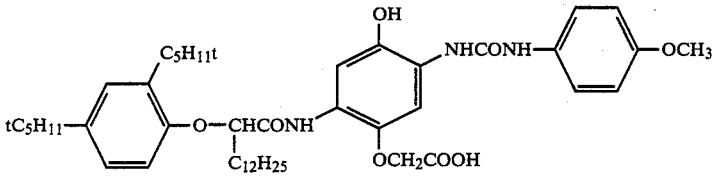
(18)
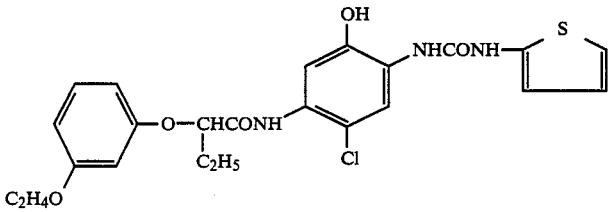
(19)
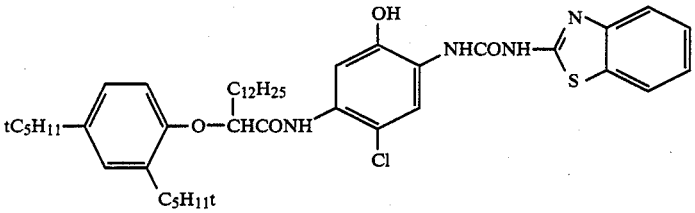
(20)
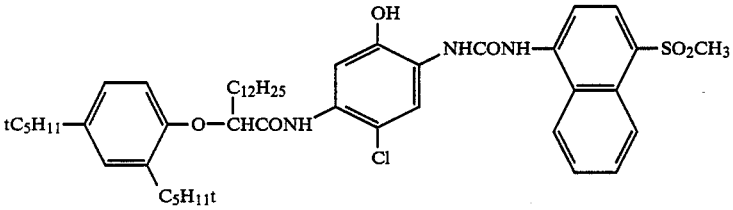
(21)
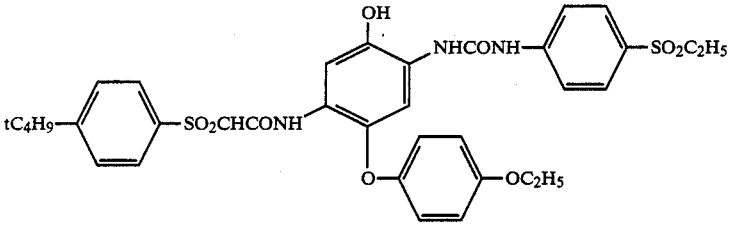
(22)
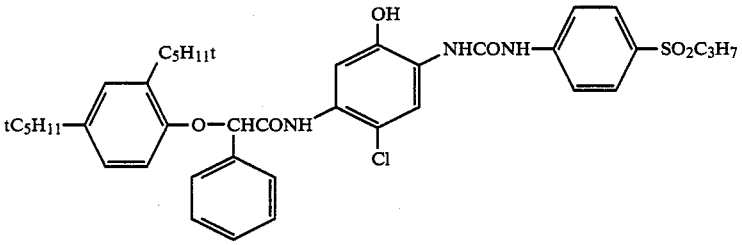

-continued
(23)
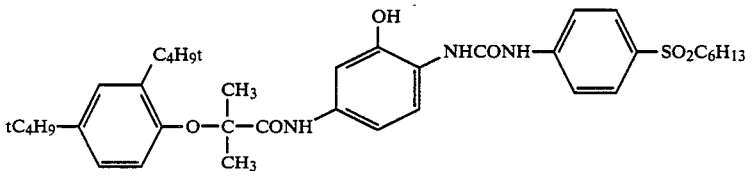
(24)
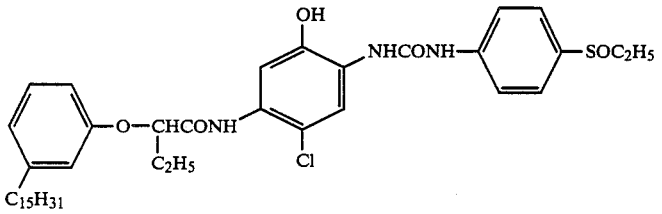
(25)
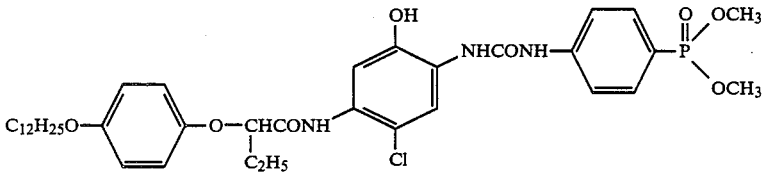
(26)
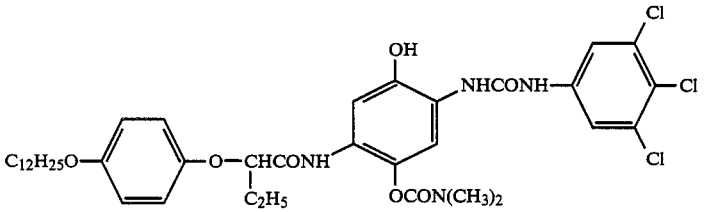
(27)
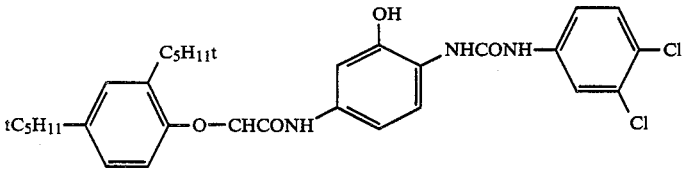
(28)
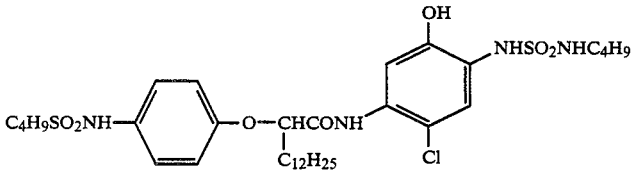
(29)
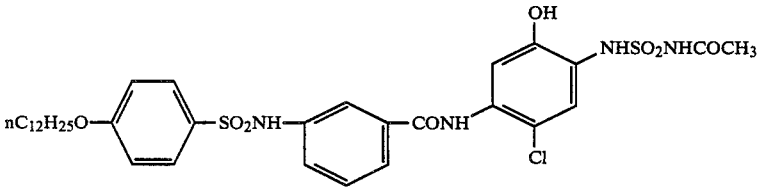
(30)
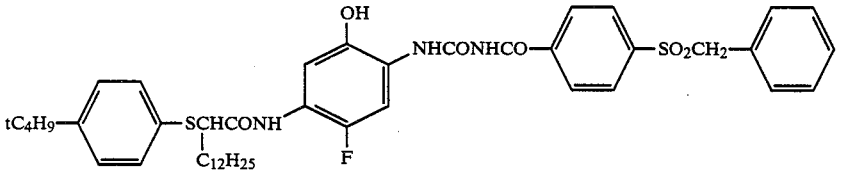

-continued
(31)
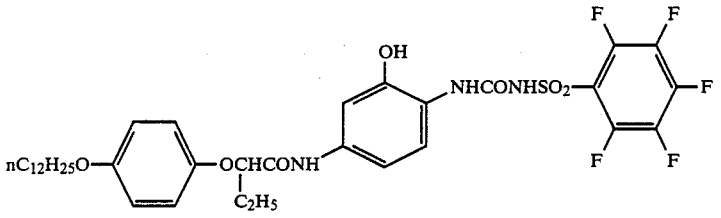
(32)
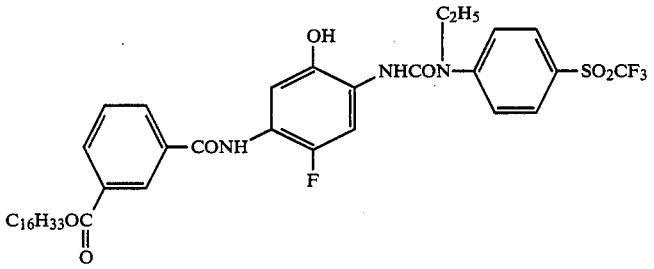
(33)
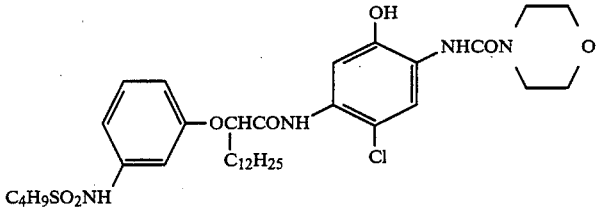
(34)
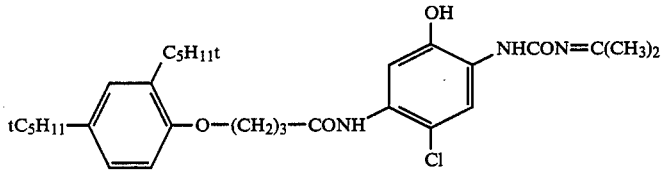
(35)
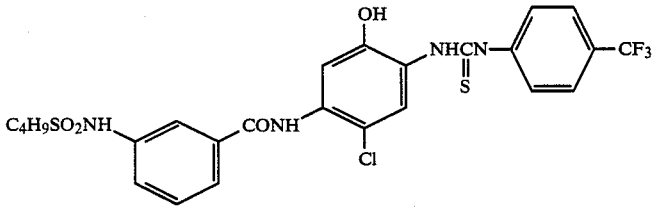
(36)
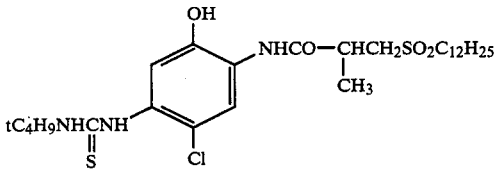
(37)
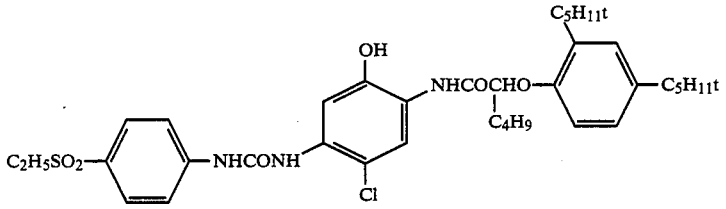

-continued
(38)
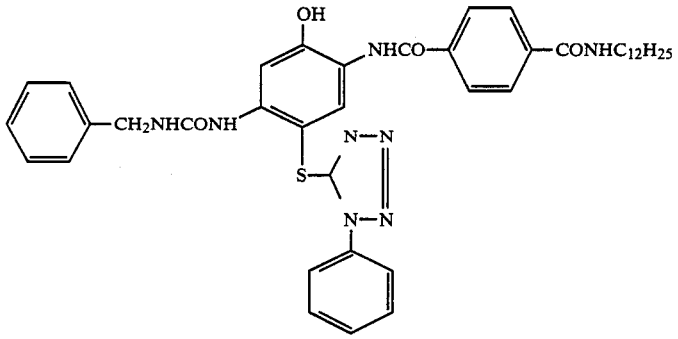
(39)
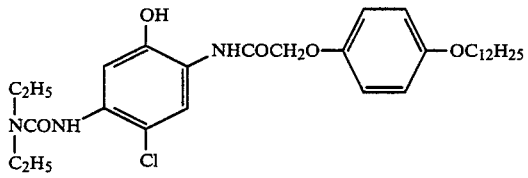
(40)
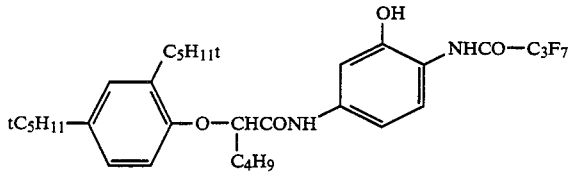
(41)
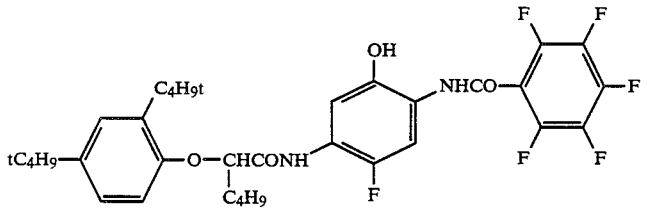
(42)
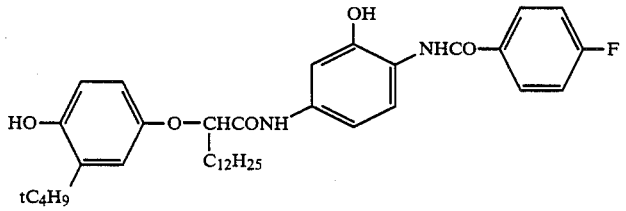
(43)
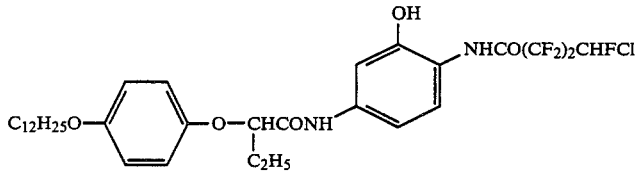
(44)
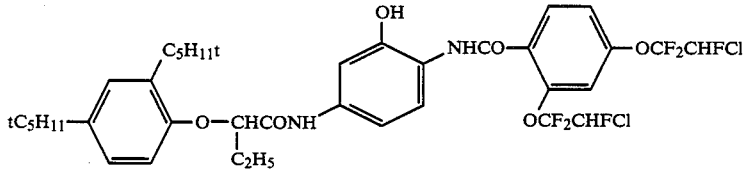

-continued
(45)
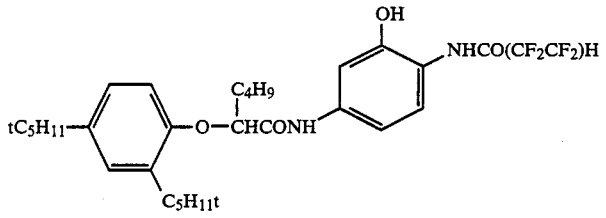
(46)
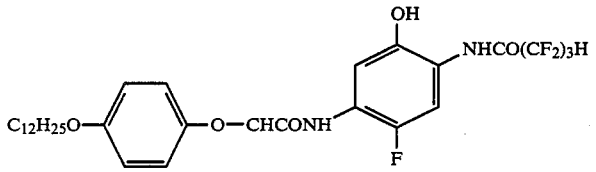
(47)
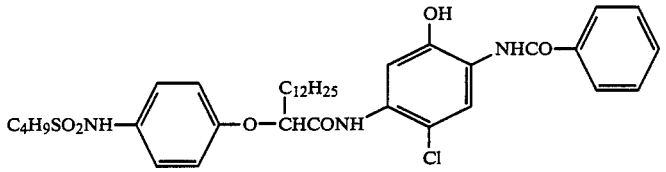
(48)
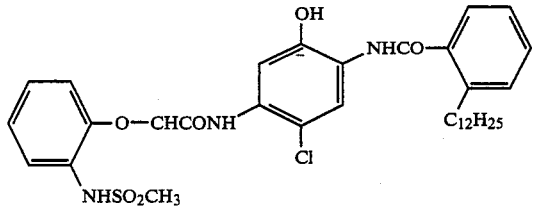
(49)
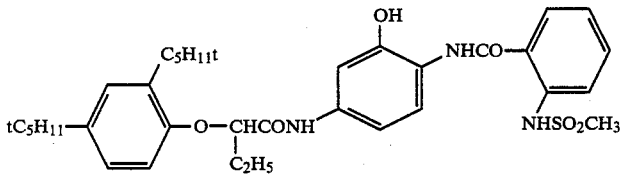
(50)
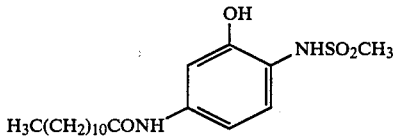
(51)
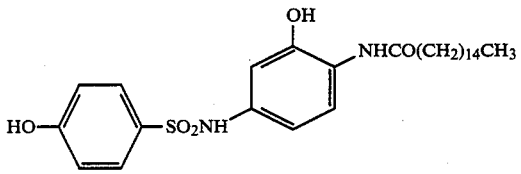
(52)
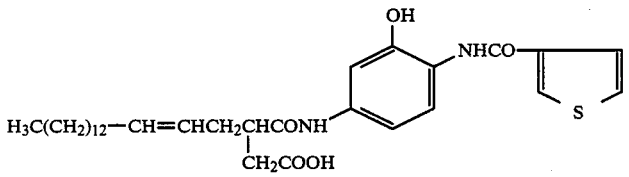

-continued
(53)
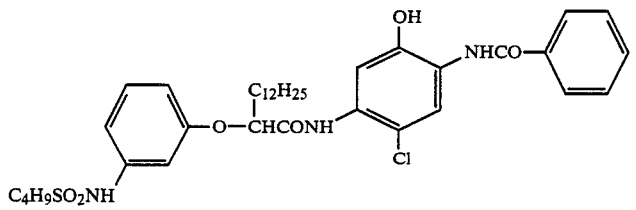
(54)
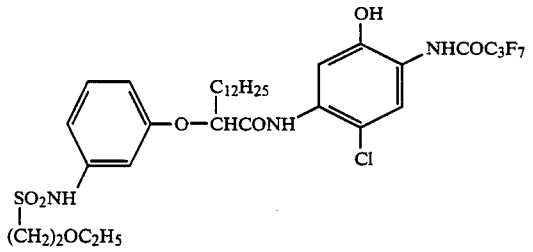
(55)
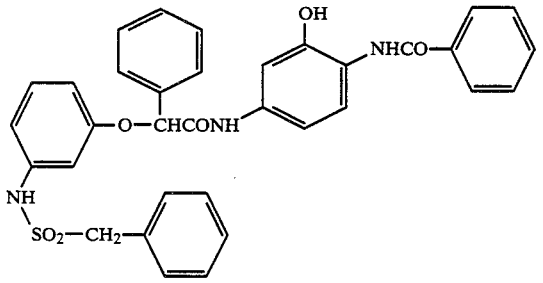
(56)
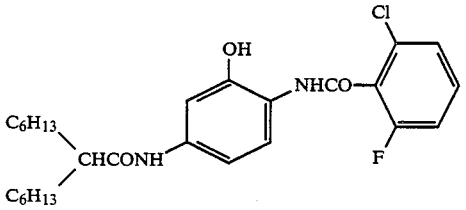
(57)
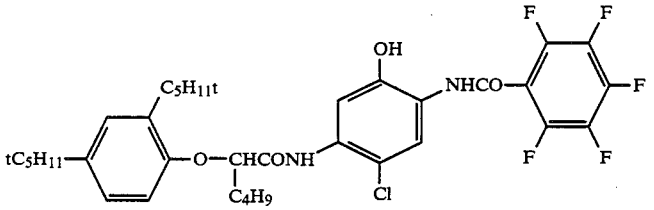
(58)
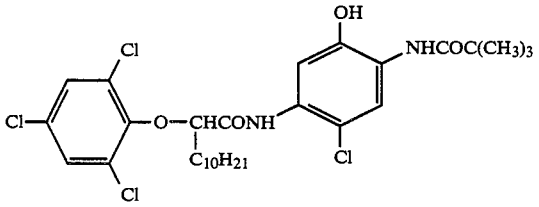
(59)
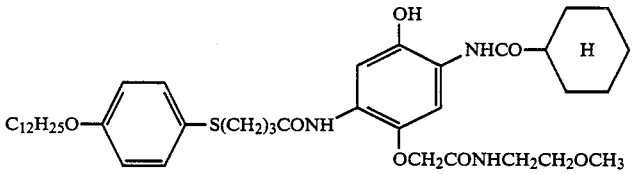

-continued
(60)
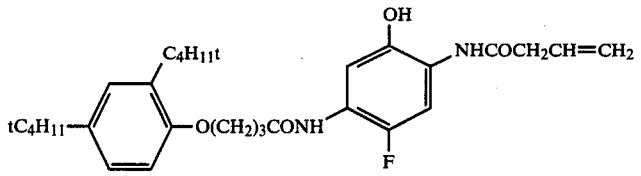
(61)
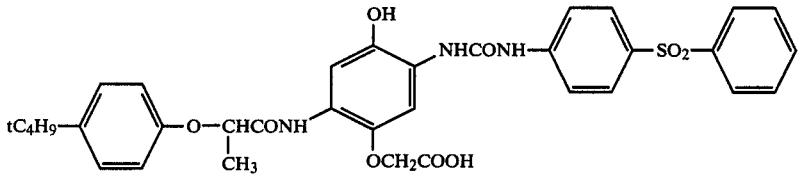
(62)
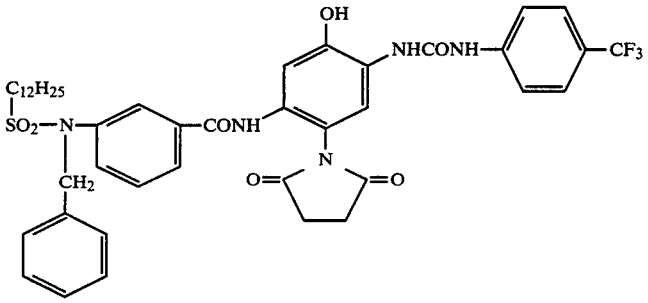
(63)
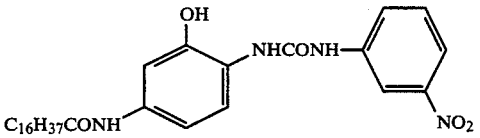
(64)
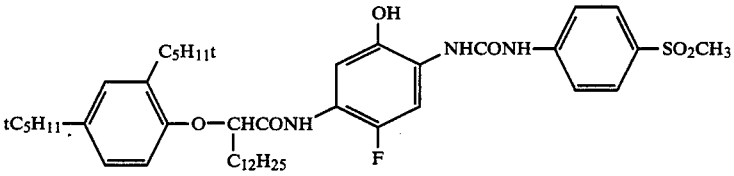
(65)
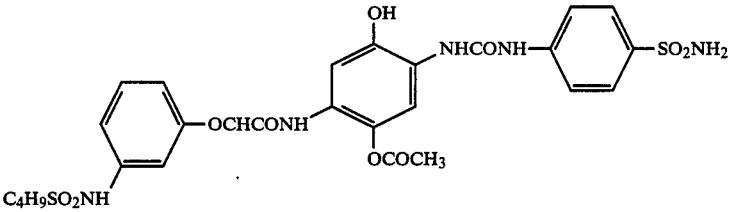
(66)
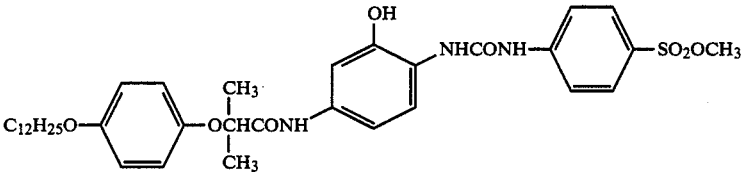

-continued

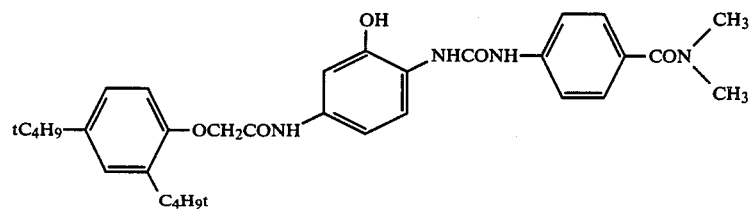

(67)

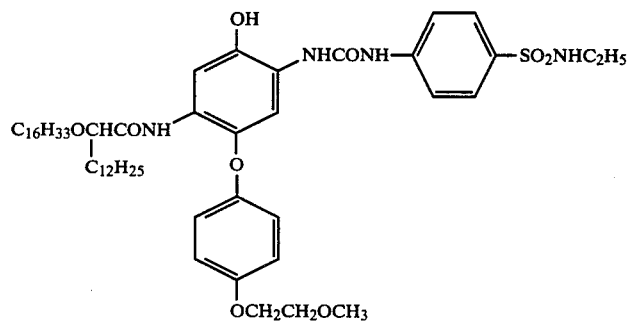

(68)

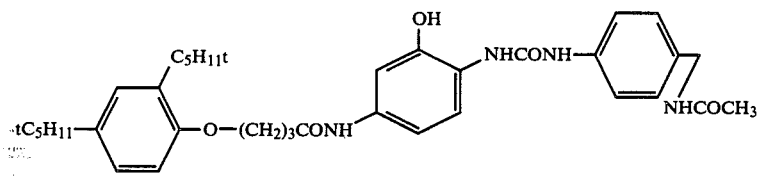

(69)

The light-sensitive silver halide color photographic material applicable for this invention may include, in adition to the internal developing system wherein chromogenic agent is contained within the light-sensitive material (see U.S. Pat. Nos. 2,376,679 and 2,801,171), external developing system wherein chromogenic agent is contained in the developer (see U.S. Pat. Nos. 2,252,718, 2,592,243 and 2,590,970). As the chromogenic agent, any one generally known in the art other than the cyan couplers as mentioned above may be available.

As the magenta chromogenic agents, there may be employed those having a skeltal structure of 5-pyrazolone ring with an active methylene group. As the yellow chromogenic agents, it is possible to use a compound having a structure of benzoylacetanilide, pivalylacetanilide or acylacetanilide with an active methylene chain, which may have or have no substituent at the coupling position. Thus, as the chromogenic agents, either the so-called diequivalent type and tetraequivalent type coupler may be applicable. The silver halide emulsion available may be any of silver halides such as silver chloride, silver iodide, silver chlorobromide, silver chloroiodide, silver iodobromide, silver chloroiodobromide and the like. As the protective colloid for these silver halides, there may be employed natural products such as gelatin and also various kinds of synthetic products. The silver halide emulsion may contain conventional additives for photography such as stabilizers, sensitizers, film hardeners, sensitizing dyes, surfactants, etc.

The support is not particularly limited and may be, for example, polyethylene coated paper, triacetate film, polyethylene terephthalate film, white polyethylene terephthalate film or the like.

The black-and-white developer to be used for processing of this invention may be one which is called as black-and-white first developer to be used in processing of light-sensitive color photographic materials generally known in the art or those to be used in light-sensitive black-and-white photographic materials, and it is possible to incorporate various additives to be added generally in black-and-white developers.

Typical additives may include developing agents such as 1-phenyl-3-pyrazolidone and hydroquinone; preservatives such as sulfites; promoters comprising an alkali such as sodium hydroxide, sodium carbonate, potassium carbonate and the like; inorganic or organic inhibitors such as potassium bromide, 2-methylbenzimidazole, methylbenzthiazole, etc.; hard water softeners such as polyphosphoric acid; surface overdeveloping preventives comprising minute amount of an iodide or a mercapto compound; and so on.

The aromatic primary amine color developing agent used in the color developer to be used in processing of this invention may include various known compounds widely used in various color photographic processes. These developers include aminophenol type and p-phenylenediamine type derivatives. These compounds are used generally in the form of salts, such as hydrochlorides or sulfates, for the purpose of stability rather than in the free forms. Also, these compounds are used at a concentration generally of about 0.1 g to about 30 g per one liter of color developer, more preferably of about 1 g to about 15 g per one liter of color developer.

Aminophenol type developers may include, for example, o-aminophenol, p-aminophenol, 5-amino-2-oxytoluene, 2-amino-3-oxy-toluene, 2-oxy-3-amino-1,4-dimethyl-benzene and the like.

Particularly useful primary aromatic amino type color developers are N,N-dialkyl-p-phenylenediamine compounds, of which alkyl group and phenyl group may be either substituted or unsubstituted. Examples of particularly useful compounds among them are N,N-diethyl-p-phenylenediamine hydrochloride, N,N-dimethyl-p-phenyldnediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, 4-amino-N-(2-methoxyethyl)-N-ethyl-3-methylaniline-p-toluenesulfonate and the like.

The alkaline color developer to be used in the processing of this invention may also contain as desired, in addition to the aforesaid primary aromatic amine type color developing agent, various components conventionally added in color developers, for example, alkali agents such as sodium hydroxide, sodium carbonate and potassium carbonate, alkali metal sulfites, alkali metal bisulfites, alkali metal thiocyanates, alkali metal halides, benzyl alcohol, water softeners and thickeners. The color developer may have a pH value generally of 7 or more, most generally about 10 to about 13.

The metal complex salt of an organic acid as the bleaching agent to be used in bleaching solution or bleach-fixing solution in the bleaching step has the action of color forming the non-color formed portion of the chromogenic agent simultaneously with oxidation of metallic silver formed by development into silver halide, and its structure comprises a metal ion such as of iron, cobalt, copper, etc. coordinated with an organic acid such as aminopolycarboxylic acid, oxalic acid, citric acid, etc.

The most preferred organic acid for formation of such a metal complex salt of organic acid may include polycarboxyic acids or aminopolycarboxylic acids. These polycarboxylic acids or aminopolycarboxylic acids may be alkali metal salts, ammonium salts or water-soluble amine salts. Typical examples of these compounds are set forth below.

[1] Ethylenediaminetetraacetic acid
[2] Diethylenetriaminepentaacetic acid
[3] Ethylenediamine-N-(β-oxyethyl)-N,N',N'-triacetic acid
[4] Propylenediaminetetraacetic acid
[5] Nitrilotriacetic acid
[6] Cyclohexanediaminetetraacetic acid
[7] Iminodiacetic acid
[8] Dihydroxyethylglycinecitric acid (or tartic acid)
[9] Ethyl ether diaminetetraacetic acid
[10] Glycol ether diaminetetraacetic acid
[11] Ethylenediaminetetrapropionic acid
[12] Phenylenediaminetetraacetic acid
[13] Disodium ethylenediaminetetraacetate
[14] Tetra(trimethylammonium) ethylenediaminetetraacetate
[15] Tetrasodium ethylenediaminetetraacetate
[16] Pentasodium diethylenetriaminepentaacetate
[17] Sodium ethylenediamine-N-(β-oxyethyl)-N,N',N'-triacetate
[18] Sodium propylenediaminetetraacetate
[19] Sodium nitrilotriacetate
[20] Sodium cyclohexanediaminetetraacetate The bleaching solution, while containing the metal complex salt of an organic acid as described above as the bleaching agent, may contain various additives. As the additive, it is desirable to incorporate a rehalogenating agent, including alkali halides or ammonium halides such as potassium bromide, sodium bromide, sodium chloride, ammonium bromide and the like. It is also possible to add suitably the additives generally known in the art to be added into bleaching solutions, for example, pH buffers such as borates, oxalates, acetates, carbonates, phosphates, etc., alkyl amines, polyethylene oxides and others.

When the bleaching step is conducted with the use of a bleach-fixing solution, the bleach-fixing solution has fixing ability in addition to bleaching ability and a solution with a composition containing the same fixing agent as used in a fixing solution in addition to a bleaching agent may be applicable. The fixing solution of bleach-fixing solution to be used may contain, other than the bleaching agent as mentioned above, a compound capable of forming a water-soluble complex salt through the reaction with a silver halide, as exemplified by thiosulfates such as potassium thiosulfate, sodium thiosulfate, ammonium thiosulfate; thiocyanates such as sodium thiocyanate, ammonium thiocyanate; or thiourea, thioether, and others.

Further, the fixing solution and the bleach-fixing solution may also contain one or two or more pH buffering agents, selected from various kinds of salts such as sulfites, including ammonium sulfite, potassium sulfite, ammonium bisulfite, potassium bisulfite, potassium metabisulfite, sodium metabisulfite and the like, boric acid, borax, sodium hydroxide, potassium hydroxide, sodium carbonate, potassium carbonate, sodium bicarbonate, potassium bicarbonate, acetic acid, sodium acetate, ammonium hydroxide, etc.

When a bleach-fixing supplemental liquid agent is supplemented separately into the bleach-fixing solution (bath), the constituent liquid agent of the present invention may contain a thiosulfate, a thiocyanate or a sulfite, but they are preferably supplemented separately from each other.

In this invention, for enhancement of the activity of the bleach-fixing solution, it is possible to blow air or oxygen into the bleach-fixing bath or into the storage tank for supplemental bleach-fixing solution, or alternatively a suitable oxidizing agent such as hydrogen peroxide, a hydrobromide, a persulfate, etc. may also be added.

In the processing of this invention, silver may be recovered from the stabilizing solution, as a matter of course, and also from other processing solutions containing soluble silver complexes such as fixing solution, bleach-fixing solution, etc. For example, there may be effectively utilized the electrolytic method (disclosed in French Pat. No. 2,299,667), the precipitation method (disclosed in Japanese Unexamined Patent Publication No. 73037/1977, German Pat. No. 2,331,220), the ion-exchange method (disclosed in Japanese Unexamined Patent Publication No. 17114/1976, German Pat. No. 2,548,237), and the metal replacement method (see U.K. Pat. No. 1,353,805).

The present invention is described in detail by referring to the following Examples, by which the present invention is not limited.

EXAMPLE 1

Six grams (6 g) of the Exemplary cyan coupler (7) of this invention as shown in the exemplary compounds and the Control coupler as shown below, 3 g of a high boiling organic solvent dibutyl phthalate and 18 g of ethyl acetate, optionally together with a necessary amount of dimethylformamide were mixed and dissolved by heating at 60° C. to prepare a solution. The resultant solution was mixed with 100 ml of an aqueous 5% gelatin solution containing 10 ml of an aqueous 5% solution of Alkanol B (alkylnaphthalene sulfonate, produced by Du Pont de Nemours & Company), followed by emulsification by means of an ultrasonic dispersing machine to prepare a dispersion.

As the next step, the dispersion was added to a silver chlorobromide emulsion (containing 10 mole % of silver chloride) so that the cyan coupler as indicated in Table 1 may be 10 mole % based on silver, and further 12 mg of 1,2-bis(vinylsulfonyl)ethane was added as the film harder per 1 g of gelatin. The resultant mixture was coated on a polyethylene coated paper support to a coated silver quantity of 5 mg/100 $cm^2$. The thus prepared color paper sample was subjected to wedge exposure in a conventional manner, followed by application of the development processings as described below.

CONTROL COUPLERS

Control coupler (1)

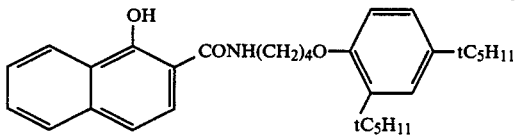

Control coupler (2)

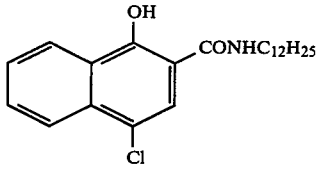

Control coupler (3)

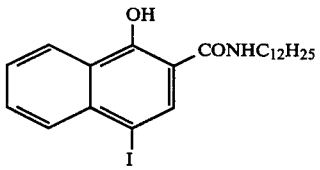

Further, by use of the couplers of the present invention (Exemplary compounds) as indicated in Table 1, samples were prepared, processed with the processing liquor for completion of running processing and provided for use in storage test of image.

The running solutions to be used in the tests were prepared by the following running processings.

Sakura color paper (in shape of roll) (produced by Konishiroky Photo Industry Co.) after picture printing was subjected to continuous supplemental processing (hereinafter called as running processing) by means of an automatic developing machine. The processing solutions during the processing steps are shown below.

Standard processing steps (processing temperature and processing time):

[1] Color developing: 38° C.; 3 min. 30 sec.
[2] Bleach-fixing: 38° C.; 1 min. 30 sec.
[3] Stabilizing processing: 25° to 30° C.; 3 min.
[4] Drying: 75° to 80° C.; about 2 min.

Compositions of processing solutions

Color developing tank solution

Benzyl alcohol: 15 ml
Ethylene glycol; 15 ml
Potassium sulfite: 2.0 g
Potassium bromide: 0.7 g
Sodium chloride: 0.2 g
Potassium carbonate: 30.0 g
Hydroxylamine sulfate: 3.0 g
Polyphosphoric acid (TPPS): 2.5 g
3-Methyl-4-amino-N-ethyl-N-(β-methanesulfonamidoethyl)aniline sulfate: 5.5 g
Fluorescent whitener (4,4'-diaminostilbenzsulfonic acid derivative): 1.0 g
Potassium hydroxide: 2.0 g
Make up to one liter with addition of water.

Supplemental solution for color developing

Benzyl alcohol: 20 ml
Ethylene glycol: 20 ml
Potassium sulfite: 3.0 g
Potassium carbonate: 30.0 g
Hydroxylamine sulfate: 4.0 g
Polyphosphotic acid (TPPS): 3.0 g
3-Methyl-4-amino-N-ethyl-N-(β-methanesulfonamidoethyl)aniline sulfate: 7.0 g
Fluorescent whitener (4,4'-diaminostilbenzsulfonic acid derivative): 1.5 g
Potassium hydroxide: 3.0 g
Made up to one liter with addition of water.

Bleach-fixing tank solution

Ferric ammonium ethylenediaminetetraacetate dihydrate: 60 g
Ethylenediaminetetraacetic acid: 3 g
Ammonium thiosulfate (70% solution): 100 ml
Ammonium sulfite (40% solution): 27.5 ml
Adjusted to pH 7.1 with potassium carbonate or glacial acetic acid and the total volume made up to one liter with addition of water.

Supplemental solution for bleach-fixing

Ferric ammonium ethylenediaminetetraacetate dihydrate: 130 g
Potassium carbonate: 20 g
Ammonium thiosulfate (70% solution): 250 ml
Ammonium sulfite (40% solution): 125 ml
Ethylenediaminetetraacetic acid: 8 g
Glacial acetic acid: 42 ml
The total volume made up to one liter, and the pH of this solution adjusted to 6.4.

The automatic developing machine was filled with the color developing tank solution and the bleach-fixing tank solution as described above and the stabilizing solution shown below. While processing the color paper, the supplemental solutions for color developing and bleach-fixing were supplemented through quantitative cups per every 3 minutes to perform running test. The amounts supplemented were 150 ml to the color developing tank and 50 ml to the bleaching tank, respectively, per 1 $m^2$ of the color paper. The amounts of stabilizing solution supplemented are as indicated in Table 1.

Stabilizing processing was conducted by modifying the stabilizing processing tank in the automatic developing machine into one tank and three tanks so that continuous processing may be performed. The respective stabilizing tanks in the automatic developing machine, except for the single tank, were arranged as first tank to third tank in the direction of the flow of a light-sensitive material, and there was employed the multi-tank countercurrent system wherein supplement solution was charged in each case into the last tank while permitting the overflow from the last tank to be flown into the tank in the precedent stage, and further permitting the overflow from said stage to be flown into the tank in the stage precedent to said stage.

The stabilizing processing time was 2 minutes irrespective of the number of the tanks, and continuous processing was performed until the total amount of the bleach-fixing supplemental solution became the same as the volume of the bleach-fixing solution tank.

The bleach-fixing solution carried over into the stabilizing solution per 1 $m^2$ of color paper was 50 ml.

The stabilizing solution and supplemental solution had the following composition:

60% Aqueous solution of 1-hydroxyethylidene-1,1-diphosphoric acid: 8.0 g
Calcium chloride: 3.5 g
2-Octyl-4-isothiazoline-3-one: 0.2 g
5-Chloro-2-methyl-4-isothiazoline-3-one: 0.2 g
Adjusted to pH 6.90 with KOH.

The amount of the stabilizing solution supplemented was varied as 8 l/$m^2$, 1 l/$m^2$, 250 ml/$m^2$, 100 ml/$m^2$, 50 ml/$m^2$, and 5 ml/$m^2$, and the self-made papers in which the couplers were varied after completion of the running test were processed. After processing, the red light density (cyan dye density) was measured and thereafter the sample was left to stand for 300 hours under irradiation of xenon lamp (80,000 lux) at a distance of 50 cm therefrom. Then, the red light density was measured and the percentage of fading of cyan dye was measured. The results are shown in Table 1.

TABLE 1

| Test No. | Stabilizing tank system | Amount supplemented (ml/$m^2$) | Coupler | Remarks | Percent fade of red density (cyan dye) 300 hr (%) |
|---|---|---|---|---|---|
| 1 | 1-tank system | 8000 (Conditions approximate to washing with water) | Control coupler (1) | Control | 23 |
| 2 | | | Exemplary compound (40) | " | 28 |
| 3 | | | Exemplary compound (53) | " | 31 |
| 4 | | | Exemplary compound (47) | " | 26 |
| 5 | | | Exemplary compound (45) | " | 24 |
| 6 | | 1000 | Control coupler (3) | " | 26 |
| 7 | | | Exemplary compound (22) | Invention | 16 |
| 8 | | | Exemplary compound (26) | " | 18 |
| 9 | | | Exemplary compound (7) | " | 14 |
| 10 | | | Exemplary compound (11) | " | 17 |
| 11 | | 250 | Control coupler (1) | Control | 28 |
| 12 | | | Exemplary compound (22) | Invention | 12 |
| 13 | | | Exemplary compound (26) | " | 14 |
| 14 | | | Exemplary compound (7) | " | 11 |
| 15 | | | Exemplary compound (11) | " | 10 |
| 16 | | 50 | Control coupler (1) | Control | 28 |
| 17 | | | Exemplary compound (40) | Invention | 14 |
| 18 | | | Exemplary compound (53) | " | 16 |
| 19 | | | Exemplary compound (47) | " | 13 |
| 20 | | | Exemplary compound (45) | " | 12 |
| 21 | | 5 | Control coupler (3) | Control | 33 |
| 22 | | | Exemplary compound (53) | Invention | 18 |
| 23 | | | Exemplary compound (40) | " | 19 |
| 24 | | | Exemplary compound (47) | " | 20 |
| 25 | | | Exemplary compound (45) | " | 14 |
| 26 | 3-tank system (cascade system) | 8000 (Conditions approximate to washing with water) | Control coupler (1) | Control | 24 |
| 27 | | | Exemplary compound (1) | " | 28 |
| 28 | | | Exemplary compound (2) | " | 30 |
| 29 | | | Exemplary compound (4) | " | 26 |
| 30 | | | Exemplary compound (27) | " | 24 |
| 31 | | 250 | Control coupler (1) | " | 24 |
| 32 | | | Exemplary compound (1) | Invention | 19 |
| 33 | | | Exemplary compound (2) | " | 21 |
| 34 | | | Exemplary compound (4) | " | 19 |
| 35 | | | Exemplary compound (27) | " | 21 |
| 36 | | 100 | Control coupler (2) | Control | 31 |
| 37 | | | Exemplary compound (1) | Invention | 16 |
| 38 | | | Exemplary compound (2) | " | 18 |
| 39 | | | Exemplary compound (4) | " | 17 |
| 40 | | | Exemplary compound (27) | " | 16 |
| 41 | | 50 | Control coupler (2) | Control | 34 |
| 42 | | | Exemplary compound (21) | Invention | 13 |
| 43 | | | Exemplary compound (22) | " | 12 |
| 44 | | | Exemplary compound (23) | " | 12 |
| 45 | | | Exemplary compound (24) | " | 11 |
| 46 | | 5 | Control coupler (1) | Control | 34 |
| 47 | | | Exemplary compound (21) | Invention | 18 |
| 48 | | | Exemplary compound (22) | " | 19 |
| 49 | | | Exemplary compound (23) | " | 20 |
| 50 | | | Exemplary compound (24) | " | 16 |

As can also be seen from Table 1, according to any of the stabilizing processings without recourse to the present invention (Test Nos. 1 to 6, 11, 16, 21, 26 to 31, 36, 41, 46), the percentage of fading of cyan dye is large. On the other hand, in the case of Control couplers, according to the processing with small amounts of the stabilizing solution supplemented as compared with No. 1 conditions approximate to the so-called water washing processing with greater amount of the stabilizing solution supplemented, the percentage of fading of cyan dye increases with reduction of the amount suplemented.

On the other hand, when the cyan couplers of this invention are employed, the percentage of fading of cyan dye was smaller for the cases with smaller amount of stabilizing solution supplemented, i.e. Nos. 7 to 10, Nos. 12 to 15, Nos. 17 to 20, Nos. 22 to 25, Nos. 32 to 35, Nos. 37 to 40, Nos. 42 to 45 and Nos. 47 to 50, than for the cases of Nos. 2 to 5 and Nos. 27 to 30 with greater amounts supplemented relative to the amount carried over by a light-sensitive material.

Substantially the same results were obtained when the stabilizing processing was conducted by use of six stabilizing tanks arranged as first tank to sixth tank in the same manner as in the case where the three tank system was employed.

As described above, according to the stabilizing processing with smaller amount of stabilizing solution supplemented by use of the coupler of this invention, it can be appreciated that the light fading percentage of cyan dye, which was increased in the case of using the coupler of the prior art, it can be seen that it will contrariwise be made smaller.

EXAMPLE 2

Samples were prepared according to the same method as in Example 1 and processing tests were conducted therefor. However, bleach-fixing processing was divided into bleaching processing and fixing processing. As the bleaching solution and the fixing solution, Sakura Color negative processing agents (CNK-4, produced by Konishiroku Photo Industry Co.) CN-2R and CN-3R were employed and the use solution and the supplemental solution were prepared according to the respective processing manuals and provided for use in processing. The color developing solution and the stabilizing solution employed were the same as in Example 1. The processing steps and the amounts supplemented were as follows.

| Processing step | Temperature | Time | Amount supplemented |
|---|---|---|---|
| [1] Color developing | 38° C. | 3 min. 30 sec. | 150 ml/m$^2$ |
| [2] Bleaching | 38° C. | 1 min. | 75 ml/m$^2$ |
| [3] Fixing | 38° C. | 1 min. | 75 ml/m$^2$ |
| [4] Stabilizing | 38° C. | 2 min. | Similarly as in Example 1, running test was conducted at various stages of 8 lit, 250 ml, 100 ml, 50 ml and 5 ml. |

After the running processing, the samples were processed similarly processed as in Example 1 and immediately subjected to measurement of the red light densities and stored under xenon lamp to determine the light fading percentages. As the result, similar results as in Example 1 were obtained to verify the fact that the coupler of this invention is also suitable for stabilizing processing with smaller amount of supplement even in the case of fixing processing. As a consequence, the step of washing with water could be omitted and color photograph with stable dye image was obtained.

As apparently seen from the foregoing Examples, according to the present invention stable color photographic images could be formed which are stable during a long term storage even when the step of washing with water may be omitted, and at the same time the amount of the stabilizing solution supplemented can be lowered or the number of stabilizing processing baths can be reduced. With such effects, pollution load and cost can be lowered with additional advantage of accomplishing compaction of the processing instrument.

We claim:

1. A method for processing of a light-sensitive silver halide color photographic material comprising imagewise exposing and developing said light-sensitive silver halide color photographic material, said developing comprising color developing and a continuous processing method comprising fixing or bleach-fixing and a stabilizing processing step involving substantially no water washing step after fixing or bleach-fixing, wherein said light-sensitive silver halide color photographic material contains at least one of cyan couplers represented by the formula [I] or [II] shown below, and the amount of stabilizing solution supplemented is 0.1 to 30 times the amount carried over from the bath for said fixing or bleach-fixing per unit area of said light-sensitive material to be processed:

Formula (I)

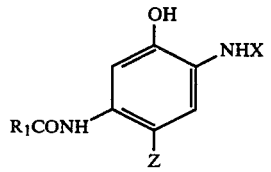

Formula (II)

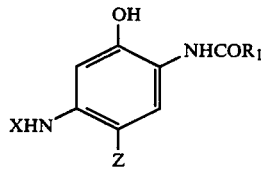

wherein X represents

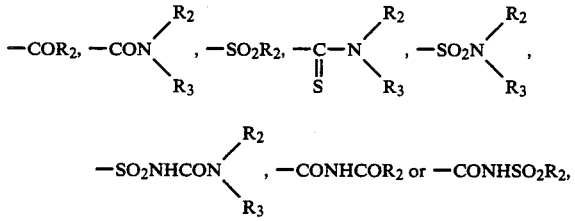

wherein $R_2$ is a substituted or unsubstituted alkyl group, alkenyl group, cycloalkyl group, aryl group or hetero ring; $R_3$ is a hydrogen atom, an alkyl group, an alkenyl group, a cycloalkyl group, an aryl group or a hetero ring; or $R_2$ and $R_3$ may be bonded together to form a 5- or 6-membered ring, $R_1$ represents a ballast group and Z represents a hydrogen atom or an eliminable group through coupling with the oxidized product of an aromatic primary amine color developing agent, wherein said eliminable group represented by Z is a halogen atom; or an aryloxy group, a carbamoyloxy group, a carbamoylmethoxy group, an acyloxy group, a sulfonamide group or a succinimide group, of which oxygen atom or nitrogen atom is bonded directly to the coupling position.

2. The method according to claim 1, wherein the group represented by $R_2$ is an alkyl group having 1 to 20 carbon atoms, an alkenyl group having 2 to 20 carbon atoms, a cycloalkyl group of a 5- to 7-membered ring, a phenyl group, a tolyl group, a naphthyl group, or a heterocyclic group of a 5- or 6-membered ring containing 1 to 4 nitrogen atom, oxygen atom or sulfur atom;

and the group represented by $R_3$ is a hydrogen atom or the group represented by $R_2$.

3. The method according to claim 1, wherein the ballast group represented by $R_1$ is a ballast group necessary for imparting diffusion resistance to the cyan coupler represented by the formulae [I] and [II] and the cyan dye formed from said cyan coupler.

4. The method according to claim 1, wherein the cyan coupler is selected from the group consisting of cyan couplers represented by the formula [III], the formula [IV] and the formula [V] shown below:

Formula (III)

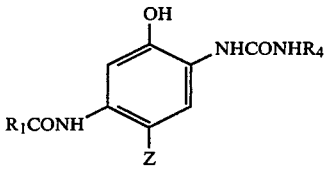

Formula (IV)

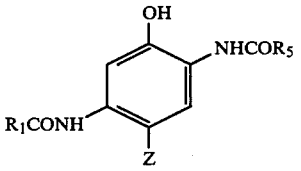

Formula (V)

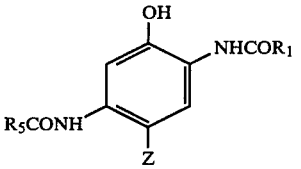

wherein $R_4$ in the formula [III] is an unsubstituted aryl group or an aryl group substituted with at least one of substituents selected from the group consisting of $-SO_2R_2$, halogen atoms, $-CF_3$, $-NO_2$, $-CN$, $-COR_6$, $COOR_6$, $-SO_2OR_6$, $$-CON\begin{matrix}R_6\\R_7\end{matrix},\ -SO_2N\begin{matrix}R_6\\R_7\end{matrix},\ -OR_6,\ -OCOR_6,\ -N\begin{matrix}R_7\\COR_2\end{matrix},$$

$$-N\begin{matrix}R_7\\SO_2R_6\end{matrix},\ \text{and}\ -\overset{O}{\overset{\|}{P}}\begin{matrix}OR_6\\OR_7\end{matrix},$$

wherein $R_6$ represents an alkyl group having 1 to 20 carbon atoms, an alkenyl group having 2 to 20 carbon atoms, a cycloalkyl group of a 5- to 7-membered ring, or an aryl group selected from phenyl group, tolyl group, naphthyl group, and $R_7$ represents a hydrogen atom or a group represented by the $R_6$); $R_5$ in the formulae [IV] and [V] is an alkyl group having 1 to 20 carbon atoms, an alkenyl group having 2 to 20 carbon atoms, a cycloalkyl group of a 5- to 7-membered ring, an aryl group selected from phenyl group, tolyl group, naphthyl group, or a heterocyclic group of a 5- to 6-membered heterocyclic ring containing 1 to 4 nitrogen atom, oxygen atom or sulfur atom; and Z and $R_1$ in the formulae [III], [IV] and [V] are the same as defined above.

5. The method according to claim 4, wherein the group represented by $R_4$ in the Formula [III] is a substituted or unsubstituted phenyl group.

6. The method according to claim 4, wherein the groups represented by $R_6$ and $R_7$ in the formula [III] and the group represented by $R_5$ in the formulae [IV] and [V] include as a substituent a halogen atom introduced therin.

7. The method according to claim 4, wherein the ballast gruoup represented by $R_1$ is a group represented by the formula [VI] shown below:

Formula [VI]

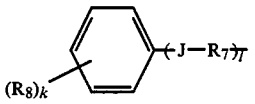

wherein J represents an oxygen atom or a sulfur atom or a sulfonyl group; k is an integer of 0 to 4; l is 0 or 1; when k is 2 or more, $R_8$ exsiting in number of two or more are either the same or different; $R_7$ is an alkylene group having 1 to 20 carbon atoms which is straight, branched or substituted with aryl group; $R_8$ represents a monovalent group selected from the group consisting of hydrogen atom, halogen atoms, straight or branched alkyl groups having 1 to 20 carbon atoms, heterocyclic groups, straight or branched alkoxy groups having 1 to 20 carbon atoms, aryloxy groups, hydroxy, acyloxy groups, carboxy straight or branched alkyloxycarbonyl groups having 1 to 20 carbon atoms, aryloxycarbonyl groups, alkylthio groups having 1 to 20 carbon atoms, acyl groups, acylamino groups, sulfonamide groups, carbamoyl groups and sulfamoyl groups.

8. The method according to claim 1, wherein said amount of stabilizing solution supplemented is 3 to 30 times in the case of one stabilizing processing tank.

9. The method according to claim 1, wherein said amount of stabilizing solution supplemented is 0.3 to 20 times in the case of two stabilizing processing tanks.

10. The method according to claim 1, wherein said amount of stabilizing solution supplemented is 0.1 to 10 times in the case of three stabilizing processing tanks.

11. The method according to claim 1, wherein said amount of stabilizing solution supplemented is 0.1 to 5 times in the case of four stabilizing processing tanks.

12. The method according to claim 1, wherein said stabilizing solution has a pH of 0.1 to 10.

13. The method according to claim 1, wherein said stabilizing processing is carried out at a temperature of about 15° to 60° C. for about 20 seconds to 10 minutes.

* * * * *